US005484182A

United States Patent [19]

Meisner

[11] Patent Number: 5,484,182

[45] Date of Patent: Jan. 16, 1996

[54] ADJUSTABLE HANDLE FOR HOLDING CONTAINERS

[75] Inventor: Edward H. Meisner, Short Hills, N.J.

[73] Assignee: Eagle Affiliates, Inc., Harrison, N.J.

[21] Appl. No.: 268,006

[22] Filed: Jun. 28, 1994

[51] Int. Cl.[6] ..... A45F 5/10; B65G 7/12

[52] U.S. Cl. ..... 294/165; 294/141; 294/164; 294/169

[58] Field of Search ..... 294/27.1, 28, 31.2, 294/32, 137, 141, 162–167, 169

[56] References Cited

U.S. PATENT DOCUMENTS

| | | | |
|---|---|---|---|
| 1,857,598 | 5/1932 | Longaker | 294/164 |
| 2,255,633 | 9/1941 | Wagner | 294/169 |
| 2,337,580 | 12/1943 | Webser | 294/164 |
| 4,040,551 | 8/1977 | Brumbauggh | 294/165 |
| 4,043,493 | 8/1977 | Camelio | 294/165 |

*Primary Examiner*—Dean Kramer

*Attorney, Agent, or Firm*—Caesar, Rivise, Bernstein, Cohen & Pokotilow, Ltd.

[57] ABSTRACT

A lightweight handle for containers is adjustable to permit the carrying, transporting and storage of containers of different sizes. The handle comprises an upper portion which is pivotally connected to a lower portion. The pivot is closer to one of the two longitudinal members of the upper portion so that in a first orientation, the space between the upper portion and the base of the lower frame can accommodate containers of larger size. In the second orientation, the other longitudinal member of the upper portion is in the bottom position, thereby reducing the space between the upper portion and the base of the frame for carrying smaller containers.

18 Claims, 3 Drawing Sheets

FIG. 2
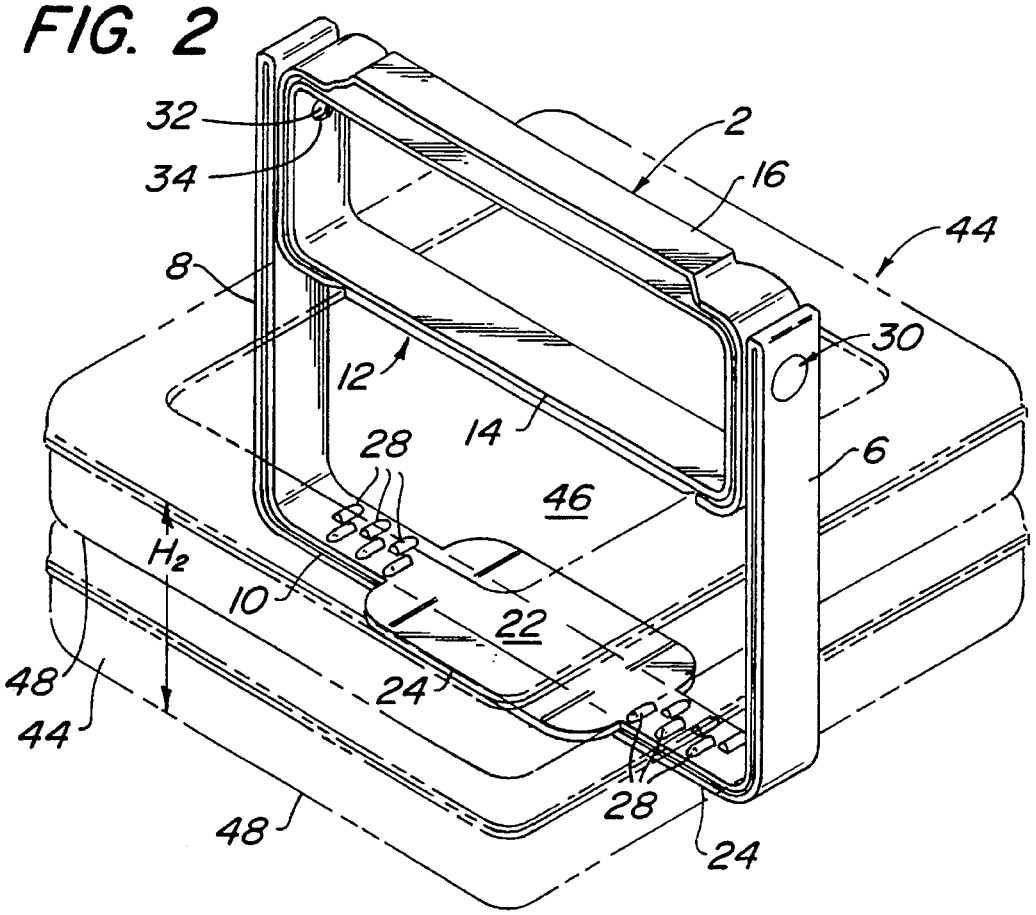
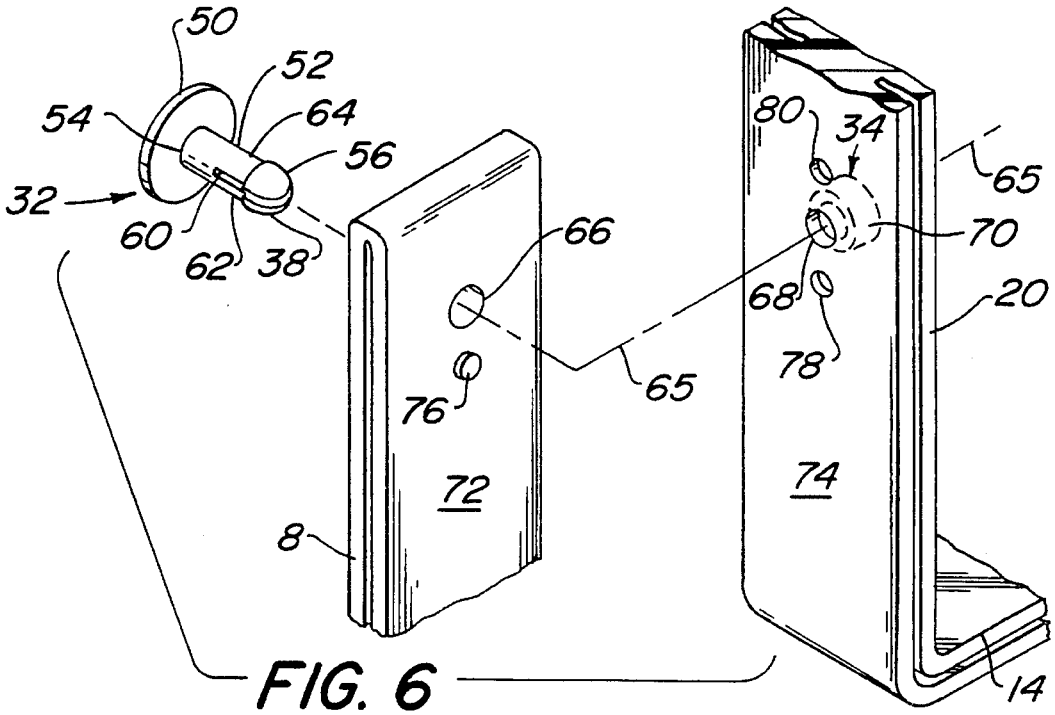
FIG. 6

FIG. 4
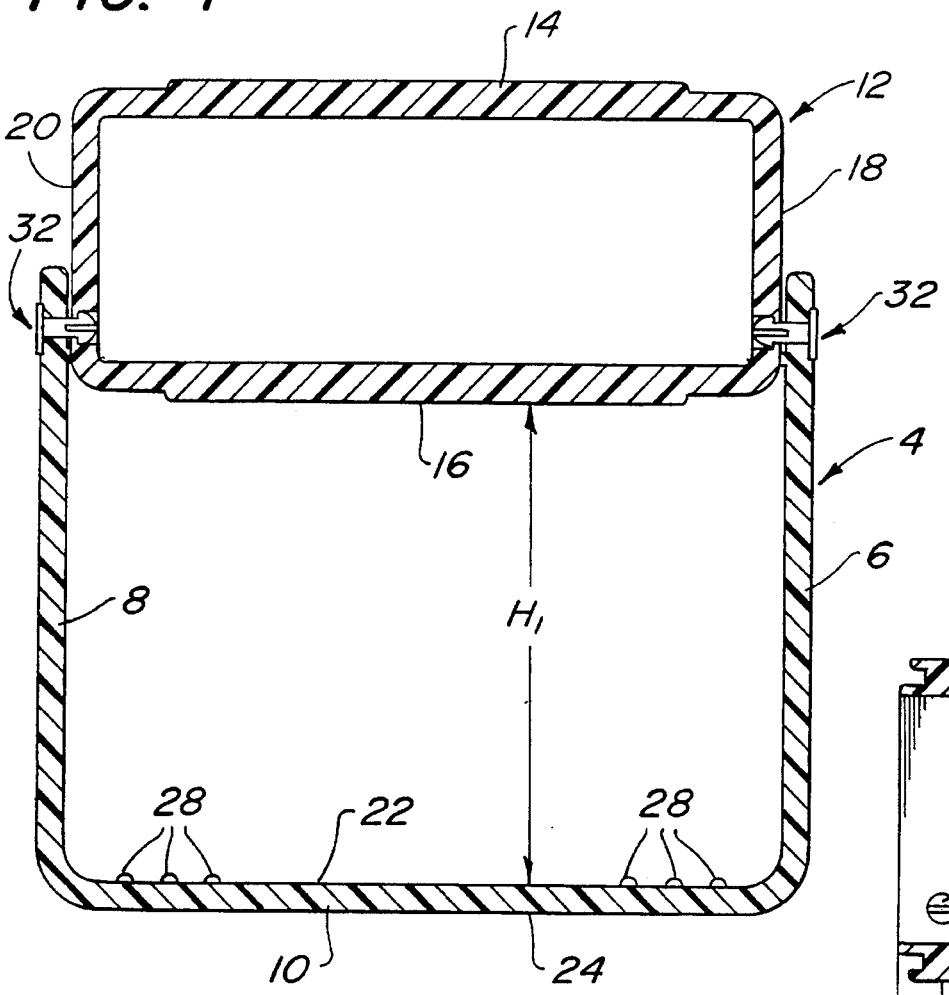
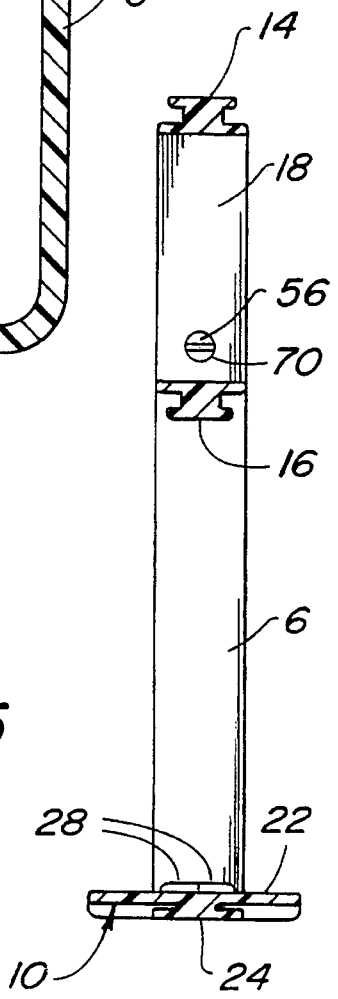
FIG. 5

ADJUSTABLE HANDLE FOR HOLDING CONTAINERS

BACKGROUND OF THE INVENTION

This invention relates generally to handles or carriers for containers and more particularly to a handle for containers which is adjustable to permit the carrying and storing of containers of different sizes.

There is a need for a lightweight, inexpensive to manufacture and easy to use, handle for containers which can easily be adjusted by the user to carry different sizes of containers.

This handle meets that need with a pivotable upper portion which can be placed in more than one orientation to permit the carrying and storing of one or a plurality of containers of various sizes.

OBJECTS OF THE INVENTION

Accordingly, it is the general object of the instant invention to provide a handle for containers which improves upon existing handles.

It is a further object of the instant invention to provide a handle for containers which is adjustable to permit the carrying of containers of different sizes.

It is still a further object of the instant invention to provide a handle with an upper portion which can be placed in more than one orientation to accommodate containers of different sizes.

It is a further object of the instant invention to provide a handle for containers which can be assembled without the use of tools and which is easily adjusted by the user.

It is still yet a further object of the instant invention to provide a handle for containers which securely clamps the container to the handle when in use.

It is another object of the instant invention to provide a handle for containers which is simple, inexpensive and easy to manufacture.

SUMMARY OF THE INVENTION

These and other objects of the instant invention are achieved by providing a handle for containers which has an upper portion pivotally connected to a lower frame and a means for changing the orientation of the upper portion with respect to the lower frame so as to permit the carrying of containers of different sizes. The pivot is adjacent to one of the longitudinal members of the upper portion so that when the upper portion is rotated about the pivot, one or the other longitudinal member is closer to the base of the frame, thereby changing the distance between them. The container or containers are securely clamped between the base and the longitudinal member closer to the base of the frame.

DESCRIPTION OF THE DRAWINGS

Other objects and many of the intended advantages of this invention will be readily appreciated when the same becomes better understood by reference to the following detailed description, when considered in connection with the accompanying drawings wherein:

FIG. 2 is a perspective view of the handle with the upper portion positioned in a second orientation to permit the holding or carrying of smaller containers;

FIG. 4 is a sectional view of the handle taken along the line 4—4 of FIG. 1;

FIG. 5 is a sectional view of the handle taken along the line 5—5 of FIG. 1; and FIG. 6 is an exploded perspective view of the pivot pin and the segments of the frame and upper portion into which the pivot pin is inserted.

DETAILED DESCRIPTION OF THE PREFERRED EMBODIMENT

Figure 1:
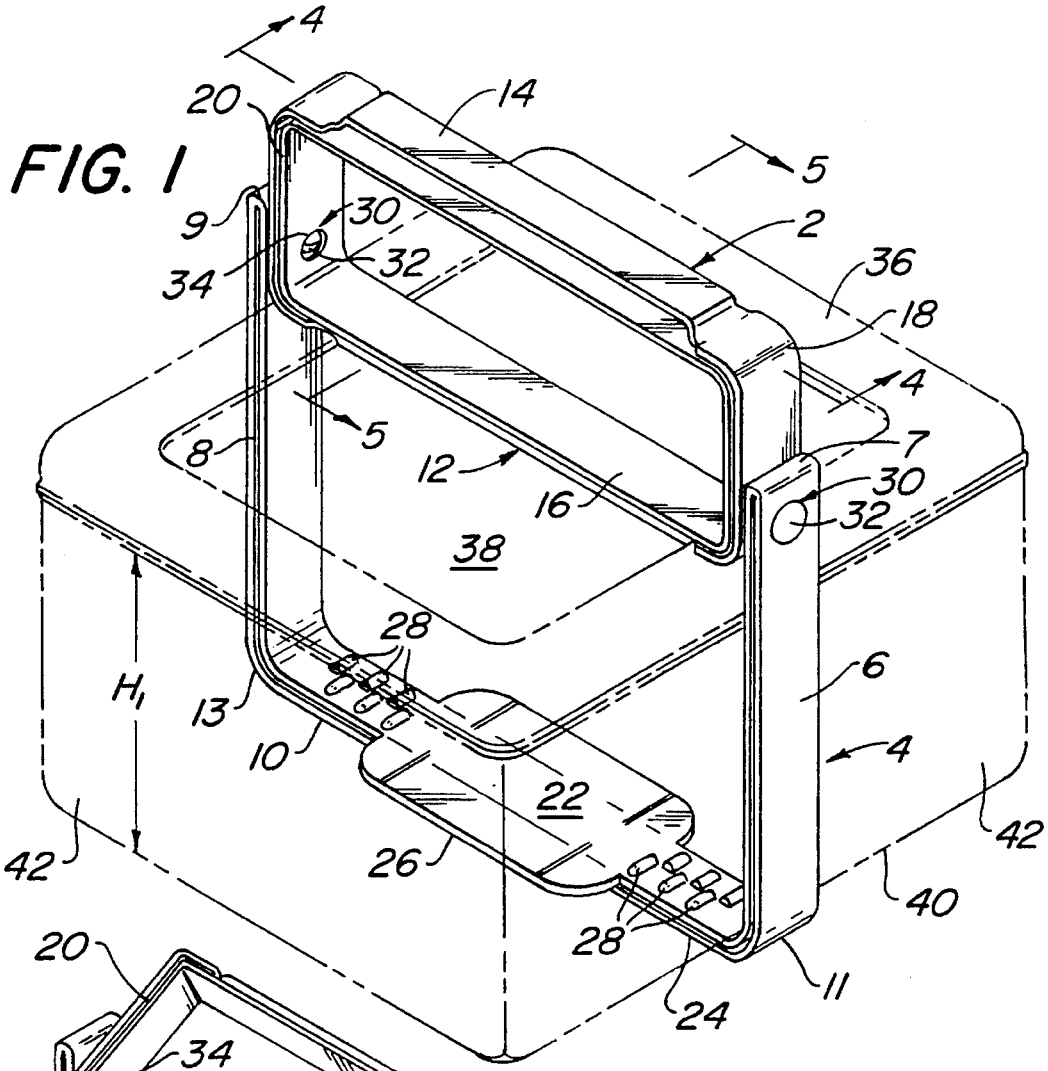
FIG. 1 is a perspective view of the handle with the upper portion positioned in a first orientation, allowing for the holding and carrying of larger containers.

Referring now in greater detail to the various figures of the drawings, wherein like reference characters refer to like parts, there is shown in FIG. 1 the handle 2 of the instant invention. The handle 2 comprises a lower frame 4 with opposing side members 6 and 8 and a base member 10, and an upper portion 12. The side members 6 and 8 each comprise proximal free ends 7 and 9, respectively, and distal ends 11 and 13, respectively. The base member 10 which is connected to the side members 6 and 8 at distal ends 11 and 13, forming the u-shaped frame 4. The upper portion 12 has opposing longitudinal members 16 and 14 connected to opposing transverse members 18 and 20 forming an open rectangular frame.

The base member 10 comprises an inner surface 22, an outer surface 24 and a central portion 26. The base also includes segmented ridges 28 disposed on each side of the central portion 26 and projecting upwardly from the inner surface 22. A container 36 having a top wall 38, a bottom wall 40, and side walls 42 is shown, with dashed lines, held securely between longitudinal member 16 and the base member 22.

The holder also includes pivots 30 which pivotally connect the upper portion 14 to the frame 4. The pivots 30 are placed in openings 34 of the opposing side members 6 and 8 near the free ends 7 and 9, respectively. Each pivot 30 comprises a pivot pin 32 placed in a hole 34 in each of the transverse members 18 and 20.

With the container 36 placed in the handle, the longitudinal member 16 presses down on the top wall 38 of the container 36 and the segmented ridges 28 press into the bottom wall 40 of the container 36 to securely hold the container within the handle. This securely clamps the container in the handle, particularly in the case of resilient plastic containers. As can be seen in FIG. 1, with the upper portion oriented so that the longitudinal member 16 is in the lower position, a container of height H1 can be carried by the handle.

Referring now to FIG. 2, the handle 2 is shown with the upper portion 12 positioned in its second orientation to permit the carrying of smaller containers 44. The containers 44 have bottom walls 48 and top walls 46. With the containers 44 held by the handle 2, the longitudinal member 14 presses down against the top wall 46 of the upper container 44 while the segmented ridges 28 press into the bottom wall 48 of the lower container 44, thereby holding the two containers 44 securely.

Figure 3:
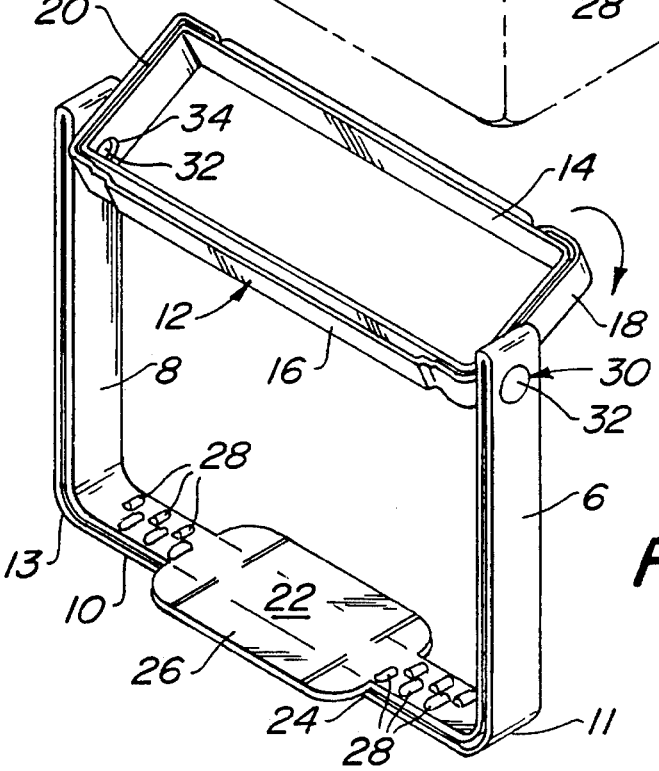
FIG. 3 is a perspective view of the handle showing the rotation of the upper portion of the handle about its pivot to change the orientation of the upper portion of the handle to the frame.

The adjustment of the upper portion 12 is shown in FIG. 3. As can be seen in FIG. 3, the upper portion 12 can be rotated in the direction of the arrow about the pivot 30. By rotating the upper portion 12 until it assumes a horizontal position, a maximum opening within the handle 2 is obtained so that a large container 42 can be placed within the handle 2 on the base 10. Then, rotating the upper portion 12 in the direction opposite to the arrow, causes the longitudinal member 16 to press against the upper wall 38 of the container 36 (FIG. 1). Similarly, for the smaller containers 44 as shown in FIG. 2, the upper portion 12 can be rotated in the direction of the arrow of FIG. 3 so that the transverse member 14 presses against the top wall 46 of the upper container 44 as shown in FIG. 2.

FIG. 4 illustrates the opening height H1 between the bottom wall 10 and the longitudinal member 16 with the upper portion 12 at its first orientation. The pivots 32 pivotally connect the transverse members 18 and 20 of the upper portion 12 with the side members 6 and 8, respectively, of the lower frame 4.

FIG. 5 shows the cross-sections of the longitudinal members 14 and 16 and the base member 10.

Referring now to FIG. 6, it can be seen that each pivot pin 32 comprises a base portion 50, a rod portion 52, having a distal end 54 connected to the base portion 50 a proximal end 56 and a knob 58, connected to the proximal end 56. A slit 60 divides the rod portion 52 into a first section 62 and a second section 64. As will be explained later, where the handle is assembled, and the pivot 32 is positioned, the sections 62 and 64 are squeezed together assuring a tight fit for the pivot pin 32.

The side member 8 and the transverse member 20 have coaxial holes 66 and 34, respectively, through which the pivot pin is placed with the knob 58 first. It should also be noted that the hole 34 in the transverse member 20 comprises a smaller hole 68 in front of a larger hole 70. Thus, when the pivot pin 32 is forced through the holes 66 and 34, the knob 58 extends fully into the larger hole 70. In this position, the sections 62 and 64 are no longer squeezed together and therefore, the knob 58 expands to its previous dimensions, thereby securely holding the pivot pins 32.

The side member 8 also has an inner surface 72 and a peg 76 projecting inwardly from the inner surface 72. The transverse member 20 has an inner surface 74 with two holes 78 and 80 which mate, with the peg 26 to lock the upper portion 12 into position at each of its orientations. For example, with the upper portion 12 in its second orientation as shown in FIG. 2, the peg 76 will mate with the hole 78 to lock the upper portion 12 into position. In the first orientation of the upper portion 12, as shown in FIG. 1, the pin 76 will mate with the hole 80 to lock the upper portion 12 into position.

It should be noted at this point, that the structure of the handle 2 with respect to the side member 8 and its respective transverse member 20 is identical with the structure of the side member 6 and its respective transverse member 18. The drawings were not repeated and described for these members 6 and 18, in the interest of brevity.

Although in the embodiments shown, one large container is shown held by the handle in its first orientation, a plurality of smaller containers with the same total vertical dimension of the large container can be held. Similarly, with the handle in its second orientation, although two containers were shown held by the handle, a single container with the same vertical dimension as the total vertical dimension of two containers can be held.

The handle can be inexpensively manufactured using extruded plastics, which makes it light in weight and rugged for general use. It can be easily adjusted by the user, without the use of tools, to carry containers of different sizes.

Without further elaboration, the foregoing will so fully illustrate my invention, that others may, by applying current or future knowledge, readily adapt the same for use under the various conditions of service.

I claim:

1. An adjustable handle for transporting and storing a single container or a stack of plural containers, each of the containers having a top surface and a bottom surface, said handle comprising a frame, an upper portion and a means for changing the orientation of said upper portion with respect to said frame from a first orientation to a second orientation and vice versa to permit the transporting of containers of different sizes, said frame having a bottom member for supporting the bottom surface of a container thereon, said upper portion comprising a first member and a second member, said first member being disposed directly above said bottom member and separated by a first predetermined spacing when said upper portion is in said first orientation to engage the top surface of a single container on the bottom member or the top surface of a stack of containers on the bottom member, said second member being disposed directly above said bottom member and separated by a second predetermined spacing, different than said first spacing, when said upper portion is in said second orientation to engage the top surface of a single container on the bottom member or a stack of containers on the bottom member.

2. The adjustable handle of claim 1 wherein said means for changing the orientation of said upper portion comprises a first and second pivot which pivotably connect said upper portion to said frame to cause said upper portion to be in either said first orientation or said second orientation.

3. The adjustable handle of claim 2 wherein said first and second members of said upper portion are longitudinally extending members, and wherein said upper portion additionally comprises opposing first and second transverse members, and wherein said frame is u-shaped, comprising opposing side members, each having a distal end and a proximal free end, with said bottom member connected to said side members at each of said distal ends.

4. The adjustable handle of claim 3 wherein said first and said second pivots each comprise a pivot pin and each of said opposing side members has a first hole adjacent its free end and each of said transverse members has a second hole, which is coaxial to a respective first hole, and wherein each of said pivot pins is positioned through each of said respective first and second holes.

5. The adjustable handle of claim 4 wherein said pivot pin comprises a base portion, a rod portion with a distal end connected to said base portion, and a proximal end, and said pivot pin further comprises a knob connected to said proximal end.

6. The adjustable handle of claim 5 wherein said pivot further comprises means for snapping said pivot pin into position in said first and second holes and said means for snapping said pivot into position comprises a slit in said proximal end of said rod portion and in said knob, enabling said rod portion at said proximal end and said knob to be squeezed when said pivot pin is pushed through said respective first and second holes and to return said knob to it original size after the pivot pin has been positioned.

7. The adjustable handle of claim 6 wherein said bottom member comprises an inner surface and a plurality of segmented ridges extending upward from said inner surface to grip the bottom surface of said single container or the bottom surface of one said stack of plural containers when said single container or stack of plural containers are held by said handle.

8. The adjustable handle of claim 7 wherein said pivots are located adjacent said first longitudinal member and said pivots comprise means for positioning said upper portion in said first orientation and said second orientation.

9. The adjustable handle of claim 8 wherein in said first orientation said first longitudinal member is positioned closer to said bottom member than said second longitudinal member with said single container or stack of plural containers held between said first longitudinal member and bottom member and wherein in said second orientation, said second longitudinal member is positioned closer to said bottom member than said first longitudinal member with said single container or stack of plural containers held between said second longitudinal member and said bottom member.

10. The adjustable handle of claim 9 wherein each of said transverse members has an inner surface and said means for positioning said upper portion in said first orientation and said second orientation comprises a first and a second peg projecting inwardly from said inner surfaces, respectively, of said first and second transverse members, and fifth and sixth holes in each of said side members, each of said pegs being positioned in a respective fifth hole with said upper portion in said first orientation and each of said pegs being positioned in a respective sixth hole with said upper portion in said second orientation.

11. The adjustable handle of claim 10 wherein each of said second holes comprises a third hole and a fourth hole of larger diameter than said third hole, said holes being coaxial, with said rod member projected through said third hole and said knob member located in said fourth hole when said pivot pin is snapped into position.

12. The adjustable handle of claim 3 wherein said pivots are located adjacent said first longitudinal member and said pivots comprise means for positioning said upper portion in said first orientation and said second orientation.

13. The adjustable handle of claim 12 wherein in said first orientation said first longitudinal member is positioned closer to said bottom member than said second longitudinal member with said single container or stack of plural containers held between said first longitudinal member and said bottom member and wherein in said second orientation, said second longitudinal member is positioned closer to said bottom member than said first longitudinal member and said single container or stack of plural containers are held between said second longitudinal member and said bottom member.

14. The adjustable handle of claim 13 wherein each of said transverse members has an inner surface and said means for positioning said upper portion in said first orientation and said second orientation comprises a first and a second peg projecting inwardly from said inner surfaces, respectively, of said first and second transverse members, and fifth and sixth holes in each of said side members, each of said pegs being positioned in a respective fifth hole with said upper portion in said first orientation and each of said pegs being positioned in a respective sixth hole with said upper portion in said second orientation.

15. The adjustable handle of claim 14 wherein said first and said second pivots each comprise a pivot pin and each of said opposing side members has a first hole adjacent its free end and each of said transverse members has a second hole, which is coaxial to a respective first hole, and wherein each of said pivot pins is positioned through each of said respective first and second holes.

16. The adjustable handle of claim 15 wherein said pivot pin comprises a base portion, a rod portion with a distal end connected to said base portion, and a proximal end, and said pivot pin further comprises a knob connected to said proximal end.

17. The adjustable handle of claim 16 wherein said pivot further comprises means for snapping said pivot pin into position in said first and second holes and said means for snapping said pivot into position comprises a slit in said proximal end of said rod portion and in said knob, enabling said rod portion at said proximal end and said knob to be squeezed when said pivot pin is pushed through said respective first and second holes and to return said knob to its original size after the pivot pin has been positioned.

18. The adjustable handle of claim 17 wherein said bottom member comprises an inner surface and a plurality of segmented ridges extending upward from said inner surface to grip the bottom surface of said single container or the bottom surface of one said stack of plural containers when said single container or stack of plural containers are held by said handle.

* * * * *